US008087459B2

(12) United States Patent
Caldwell et al.

(10) Patent No.: US 8,087,459 B2
(45) Date of Patent: Jan. 3, 2012

(54) PACKER PROVIDING MULTIPLE SEALS AND HAVING SWELLABLE ELEMENT ISOLATABLE FROM THE WELLBORE

(75) Inventors: Rebecca Caldwell, Houston, TX (US); Patrick J. Zimmerman, Houston, TX (US); Robert Coon, Missouri City, TX (US); Henry Joe Jordan, Jr., Willis, TX (US); David Ward, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 217 days.

(21) Appl. No.: 12/415,571

(22) Filed: Mar. 31, 2009

(65) Prior Publication Data

US 2010/0243235 A1 Sep. 30, 2010

(51) Int. Cl.
*E21B 33/12* (2006.01)

(52) U.S. Cl. ..... 166/196; 166/120

(58) Field of Classification Search ..... 166/179, 166/196, 120, 136, 137
See application file for complete search history.

(56) References Cited

U.S. PATENT DOCUMENTS

| | | | |
|---|---|---|---|
| 2,657,751 | A | 11/1953 | Johnston |
| 2,725,941 | A | 12/1955 | Henshaw |
| 4,433,847 | A | 2/1984 | Weinberg |
| 4,711,301 | A | 12/1987 | Stringfellow |
| 5,423,382 | A | 6/1995 | Barton et al. |
| 5,447,200 | A | 9/1995 | Dedora et al. |
| 5,806,596 | A | 9/1998 | Hardy et al. |
| 5,810,082 | A | 9/1998 | Jordan, Jr. |
| 5,819,854 | A | 10/1998 | Doane et al. |
| 5,924,491 | A | 7/1999 | Jordan, Jr. et al. |
| 5,988,287 | A | 11/1999 | Jordan, Jr. et al. |
| 6,119,774 | A | 9/2000 | Doane et al. |
| 6,230,798 | B1 | 5/2001 | Appleton |
| 6,241,017 | B1 | 6/2001 | Doane et al. |
| 6,513,595 | B1 | 2/2003 | Freiheit et al. |
| 6,612,372 | B1 | 9/2003 | Freiheit et al. |

(Continued)

FOREIGN PATENT DOCUMENTS

CA 2 422 771 C 3/2006

(Continued)

OTHER PUBLICATIONS

TAM International; "Casing Annulus Packers and Accessories;" ISO 9001: 2000—Product Specifications.

(Continued)

*Primary Examiner* — Shane Bomar
*Assistant Examiner* — Catherine Loikith
(74) *Attorney, Agent, or Firm* — Wong, Cabello, Lutsch, Rutherford & Brucculeri, LLP

(57) ABSTRACT

A packer provides multiple seals when deployed downhole. Exposed to an activating agent, a swellable element on the packer's mandrel expands radially outward to form a seal with the borehole wall. Deformable elements, are disposed on the mandrel adjacent the swellable element. These deformable elements deform outward to the surrounding borehole wall to at least partially isolate the downhole annulus and the swellable element. Bias units releasable affixed on the tool adjacent the deformable elements can deform the elements. These bias units can be released either by swelling of the swellable element or by fluid pressure. Once released, the bias units are axially biased toward the deformable elements to deform them. In this way, the packer can form multiple seals with the borehole wall, and the deformable elements can isolate the swellable element from the downhole annulus, which can keep the swellable element from degrading or being overly extruded.

31 Claims, 7 Drawing Sheets

U.S. PATENT DOCUMENTS

| | | | | |
|---|---|---|---|---|
| 6,834,725 | B2 * | 12/2004 | Whanger et al. | 166/384 |
| 6,907,937 | B2 * | 6/2005 | Whanger et al. | 166/387 |
| 7,108,071 | B2 | 9/2006 | Freiheit et al. | |
| 7,128,147 | B2 | 10/2006 | Marcin et al. | |
| 7,143,832 | B2 | 12/2006 | Freyer | |
| 7,228,915 | B2 | 6/2007 | Thomson | |
| 7,299,882 | B2 * | 11/2007 | Brezinski et al. | 166/387 |
| 7,387,158 | B2 * | 6/2008 | Murray et al. | 166/387 |
| 7,392,841 | B2 | 7/2008 | Murray et al. | |
| 7,431,098 | B2 * | 10/2008 | Ohmer et al. | 166/387 |
| 2004/0020662 | A1 * | 2/2004 | Freyer | 166/387 |
| 2005/0110217 | A1 | 5/2005 | Wood et al. | |
| 2005/0171248 | A1 | 8/2005 | Li et al. | |
| 2005/0199401 | A1 * | 9/2005 | Patel et al. | 166/387 |
| 2006/0090905 | A1 | 5/2006 | Brennan, III et al. | |
| 2007/0027245 | A1 | 2/2007 | Vaidya et al. | |
| 2007/0151724 | A1 * | 7/2007 | Ohmer et al. | 166/187 |
| 2008/0093086 | A1 | 4/2008 | Courville et al. | |
| 2008/0149351 | A1 | 6/2008 | Marya et al. | |
| 2008/0185158 | A1 * | 8/2008 | Chalker et al. | 166/387 |
| 2008/0220991 | A1 | 9/2008 | Slay et al. | |

FOREIGN PATENT DOCUMENTS

| | | | |
|---|---|---|---|
| EP | 0094170 | | 11/1983 |
| WO | 02/36934 | A1 | 5/2002 |
| WO | 2003/008756 | | 1/2003 |
| WO | 2005/012686 | | 2/2005 |
| WO | 2008/154392 | | 12/2008 |
| WO | 2008154392 | | 12/2008 |

OTHER PUBLICATIONS

Swelltec; "GENISIS: Annulus Swellable Packer (ASP™) The failsafe standard in non-mechanical isolation tools;" Product Specifications.

Easywell; "West Africa: SmartWell® Completion—A High Value, Lowe cost SmartWell® Completion for West Africa Field;" Product Specifications, 2008.

Swelltec; "MORPHISIS: Annulus Swellable Packer (ASP™)—The failsafe standard in non-mechanical isolation tools;" Product Specifications.

Swelltec; "NEMISIS: Annulus Swellable Packer (ASP™)—The failsafe standard in non-mechanical isolation tools;" Product Specifications.

Ocean Drilling Program; "Packers and Flowmeters;" Informational Brochure published at www.oceandrilling.org.

Halliburton; "External Sleeve Inflatable Packer Collar (ESIPC™);" Internet article downloaded from http://www.halliburton.com/ps/default.aspx?pageid=338&navid=152&prodid=MSE::1063 on Aug. 14, 2008.

Packers Plus; "Open Hole Packers;" Product Specifications.

Packers Plus; "RockSeal™ IIS Open Hole Anchor / Packer / Bridge Plug;" Product Specifications.

Packers Plus; "RockSeal™ Service Tools—Test Packers;" Product Specifications.

Packers Plus; "RockSeal™ Service Tools—Straddle System;" Product Specifications.

Yakeley et al.; "Swellable Packers for Well Fracturing and Stimulation;" Copyright 2007, Society of Petroleum Engineers (SPE 110621).

Wilson et al.; "Thermally Compensated Inflatable Packers and Plugs;" Feb. 23-25, 2000.

Weatherford International Ltd.; "Ultra-Lok Packer;" Product Specifications, 2006.

Weatherford International Ltd.; "DLT Comression-Set Service Packer;" Product Specifications, 2007.

Weatherford®; "Cased-Hole Completion Services;" Sales Brochure, 2007.

Weatherford International Ltd.; "440 Casing Packer;" Product Specifications, 2007.

Weatherford International Ltd.: "Gas-Vent Pumping Packer;" Product Specifications, 2007.

Weatherford International Ltd.; "Weatherford BlackCat U Retrievable Sealbore Packer;" Product Specifications.

Weatherford International Ltd.; "WFX-Style BlackCat Packer;" Product Specifications, 2007.

Weatherford International Ltd.; "Cup Packer;" Product Specifications, 2007.

Weatherford International Ltd.; "ThunderCat Hydraulic-Set Retrievable Production Packer;" Product Specifications, 2000.

Weatherford International Ltd.; "HRP Hydraulic Retrievable Production Packer;" Product Specifications, 2007.

Weatherford International Ltd.; "32-A Tension-Set Packer;" Product Specifications, 2007.

Canadian Search Report and Search Opinion for CA Application No. 2,697,605, dated Aug. 24, 2011, 2 pages.

International Search Report for GB1007709.7, dated Jun. 4, 2010.

* cited by examiner

PACKER PROVIDING MULTIPLE SEALS AND HAVING SWELLABLE ELEMENT ISOLATABLE FROM THE WELLBORE

BACKGROUND

Operators use packers downhole to isolate portions of a wellbore's annulus when performing various operations. For example, operators can selectively frac multiple isolated zones by deploying a tool string having one or more packers into an open or cased wellbore. When activated, the packers isolate the wellbore's annulus so the isolated zones can be separately treated.

Different types of packers can be used in the wellbore. One conventional packer uses a compression-set element that expands radially outward to the borehole wall when subjected to compression. Being compression-set, the element's length is limited by practical limitations because a longer compression-set element would experience undesirable buckling and collapsing during use. However, a shorter compression-set element may not adequately seal against irregularities of the surrounding borehole wall. Moreover, this type of packer typically needs a sophisticated mechanism to actuate the compression-set element.

Another conventional packer uses an inflatable element. When deployed, a differential pressure is introduced to inflate the element so that it produces a seal with the surrounding borehole wall. Compared to a compression-set packer, however, the inflatable packer can be significantly more costly and can be more difficult to implement and deploy.

Another conventional packer uses a swellable element. When run into position downhole, fluid enlarges the swellable element until it produces a seal with the borehole wall. This can take up to several days to complete in some implementations. Once swollen, the element's material can begin to degrade during its continued exposure to the fluid, and a high differential pressure or an absence of the activating fluid that swelled the element can compromise the swellable element's seal.

In addition, the swellable element may become extruded if it is allowed to swell in an uncontrolled manner. To limit the axial swelling of the element, metal rings can anchor the top and bottom of the swellable element and prevent it from expanding axially beyond the anchoring points. Examples of such metal rings are used by TAM International and Swelltec. Backup rings may also be used in addition to the metal anchoring rings at either end, as done by Easywell, for example.

The subject matter of the present disclosure is directed to overcoming, or at least reducing the effects of, one or more of the problems set forth above.

SUMMARY

A downhole tool such as a packer provides multiple seals when deployed downhole. When exposed to an activating agent (e.g., oil, water, etc.), a swellable packer element on the tool's mandrel swells. Because the swelling may take several days to seal the downhole annulus, the tool has one or more isolation elements disposed adjacent the swellable element to at least partially isolate the downhole annulus. For example, when the tool is deployed, the swellable packer element is exposed to the activating agent so it can begin to swell. As the swellable element swells, the one or more isolation elements are activated to at least partially isolate the downhole annulus. By doing so, the isolation elements can produce one or more secondary seals (either full or partial) with the surrounding borehole wall to prevent fluid flow through the downhole annulus while the swellable element swells. In addition, the isolation elements can keep the swellable element from becoming overly extruded as it swells by limiting the axial expansion of the swellable element along the tool's mandrel. Finally, the isolation elements can at least partially isolate the swellable element from the downhole annulus and thereby limit the swellable elements exposure to downhole fluids that may tend to degrade the element over time.

The one or more isolation elements are disposed on the tool's mandrel adjacent the swellable packer element and are at least partially deformable radially outward to the surrounding borehole wall to produce the isolation discussed above. In one arrangement of an isolation element, one or more cup packers are biased to deform radially outward and are oriented to restrict fluid flow through the downhole annulus in one or more directions. These one or more cup packers may be biased to deform radially outward by their natural configuration, by fluid pressure in the downhole annulus acting on the cup packer, or by a bias unit configured to deform the cup packer.

In another arrangement of an isolation element, a compressible packer is disposed on the mandrel adjacent the swellable element, and a bias unit is releasably affixed on the mandrel adjacent the compressible packer. The bias unit is releasable on the mandrel and is axially biasable toward the compressible packer to at least partially deform the compressible packer radially outward to the surrounding borehole wall.

The bias unit can be released in a number of ways. In one arrangement, the swellable element can release the bias unit to compress the compressible packer. For example, axial swelling of the swellable element can break the bias unit's temporary connection to the mandrel. This temporary connection can use shear pins and dogs to releasably affix the bias unit on the mandrel. Once released, the bias units can then compress against the compressible packer to deform the packer.

In another arrangement, fluid pressure communicated through the mandrel can release the bias unit to compress the compressible packer. For example, fluid pressure from the mandrel's bore can enter a port and fill a chamber of the bias unit. The fluid pressure filling this chamber can then break the bias unit's temporary connection to the mandrel and can bias the unit axially toward the compressible packer to compress it.

These and other arrangements are disclosed below. The foregoing summary is not intended to summarize each potential embodiment or every aspect of the present disclosure.

DETAILED DESCRIPTION

Figure 1:
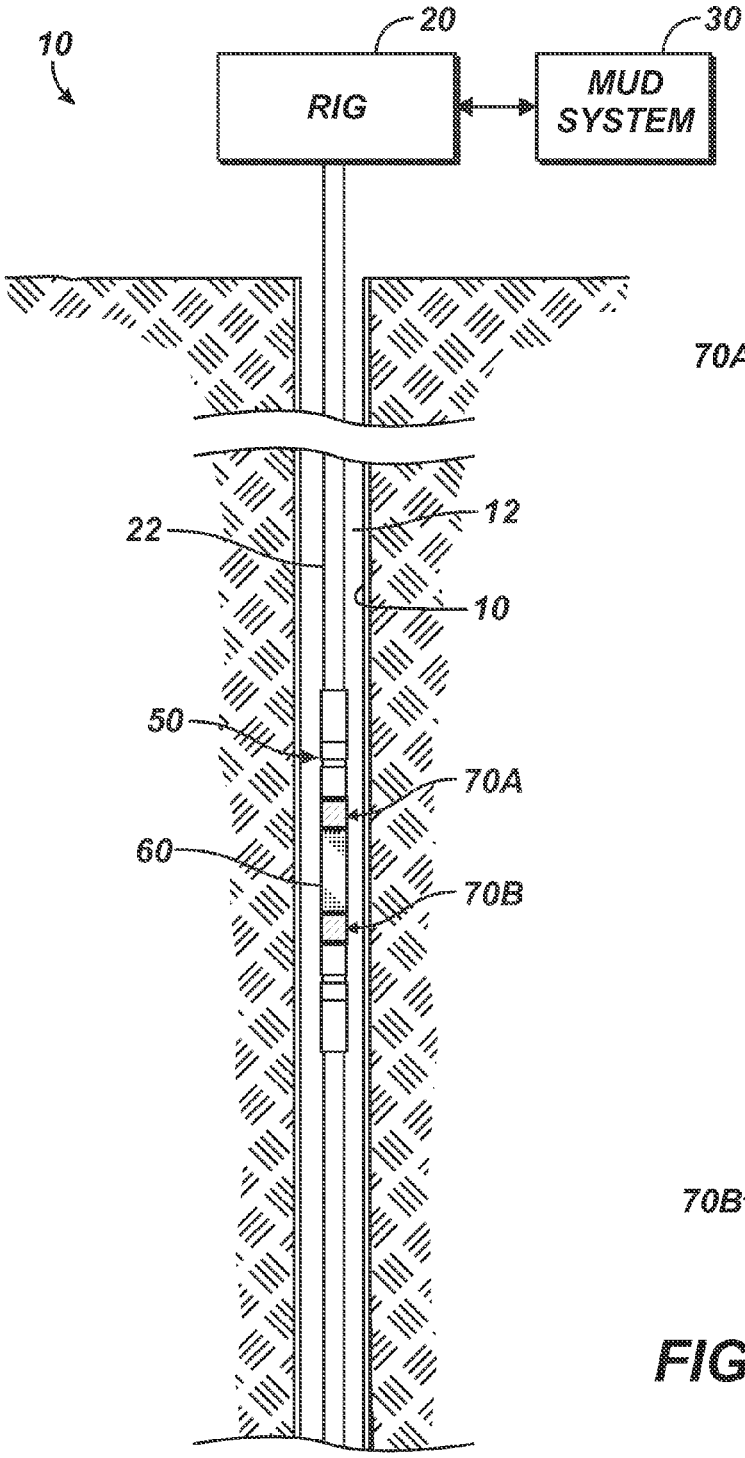
FIG. 1 illustrates a tubing string deployed downhole and having a tool with a swellable packer element capable of being isolated from the wellbore.

A tool 50 in FIG. 1 deploys downhole within a borehole 10 with a tubing string 22 extending from a rig 20 or the like. In general, the tool 50 can be a packer used to isolate the downhole annulus 12 for various operations, such as treating separate zones in a frac operation. In addition to a packer, the downhole tool 50 can be a liner hanger, a wireline lock, a bridge plug, or other tool that uses an energized annular seal to seal the downhole annulus 12. For the purposes of the present disclosure, however, reference will be made to a packer. For its part, the borehole 10 may have a uniform or irregular wall surface and may be an open hole, a casing, or any downhole tubular.

The packer 50 has one or more swellable packer elements 60 disposed on a mandrel 52 and has one or more isolation elements 70 disposed on the mandrel 52 adjacent the swellable elements 60. As shown particularly in FIG. 1, the packer 50 has one swellable element 60 and has two isolation elements 70A-B flanking the ends of the swellable element 60. When deployed downhole, an activating agent, such as water, oil, production fluid, etc., engorges the swellable element 60, expanding it from an initial hardness of about 60 Durometer to a final hardness of about 20-30 Durometer, for example. As it swells, the swellable element 60 fills the downhole annulus 12 to produce a fluid seal.

Because the swelling of the element 60 can take several days to complete (e.g., 7-10 days), fluid may still be able to travel between portions of the downhole annulus 12 past the packer 50. This may be undesirable because fluid loss and contamination may occur while the swellable element 60 continues to swell. For this reason, operators use the isolation elements 70A-B to at least partially isolate the downhole annulus 12. In generally, each of the isolation element 70A-B has one or more deformable elements. When deploying the tool 10 downhole, these one or more deformable elements of the isolation elements 70A-B are at least partially deformed radially outward to the surrounding borehole wall so the elements 70A-B can at least partially isolate the downhole annulus 12.

The isolation from the elements 70A-B can reduce or prevent issues with fluid passing through the downhole annulus 12 while the swellable element 60 swells. In addition, the isolation can prevent the swellable element 60 from over exposure to wellbore fluids in the annulus 12 (including the activating agent) that could degrade the element's material. Finally, the isolation elements 70A-B can also limit the possible extrusion of the swellable element 60 as its swells.

Figure 2:
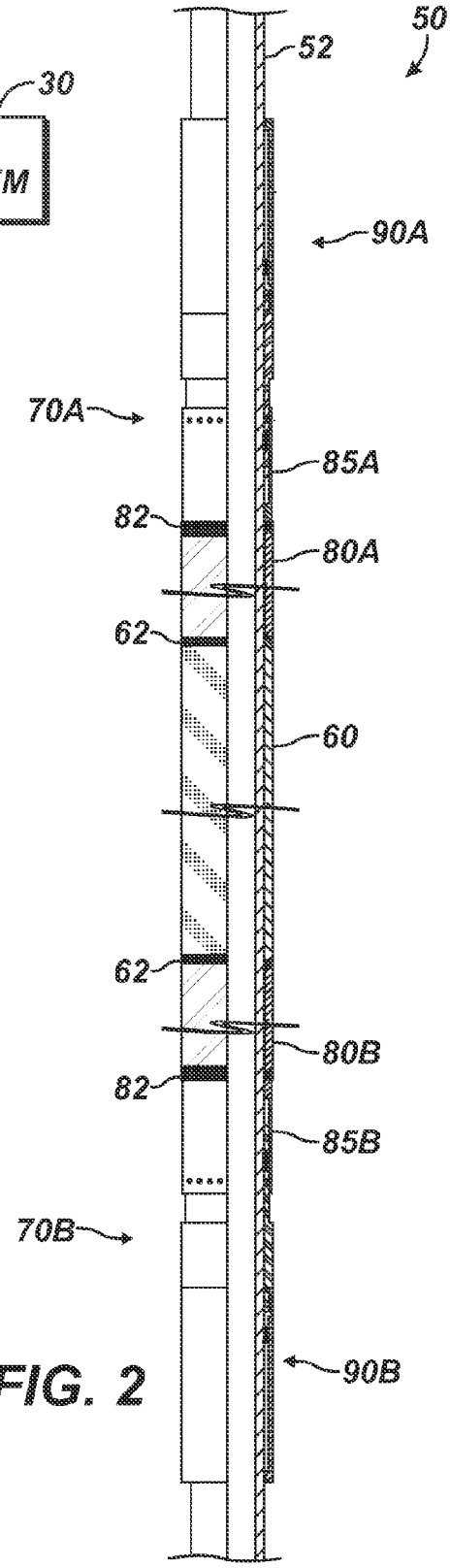
FIG. 2 illustrates a partial cross-sectional of a packer according to certain teachings of the present disclosure.

One arrangement of a packer 50 is shown in FIG. 2. Again, the packer 50 has a symmetrical arrangement with a swellable packer element 60 flanked at each end by isolation elements 70A-B as described previously. As shown, the swellable element 60 is a swellable sleeve of material that can swell in the presence of an activation agent, such as water, oil, production fluid, etc. As also shown, the isolation elements 70A-B include compressible packers 80 that deform when compressed.

When the packer 50 is deployed and activated, these elements 60/70A-B are capable of forming different seals with the surrounding borehole wall. For example, the compressible packers 80AB can provide a compressed form of seal particularly suited for sealing against uniform surfaces and for maintaining a high pressure differential. On the other hand, the swellable element 60 can provide an engorged or swollen form of seal. Although this swollen seal may be weaker than the compressed seal, the swollen seal can extend along a greater expanse of the borehole and may actually provide a better seal against less uniform surfaces downhole than can be achieved with the compressed seal.

Figure 3A:
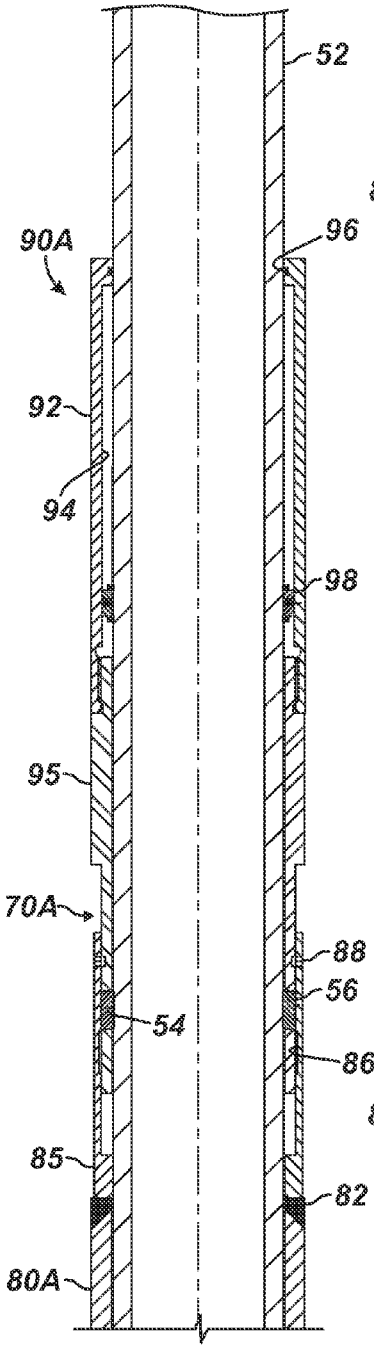
FIGS. 3A-3C illustrate detailed cross-sections of the packer in FIG. 2.
Figure 3B:
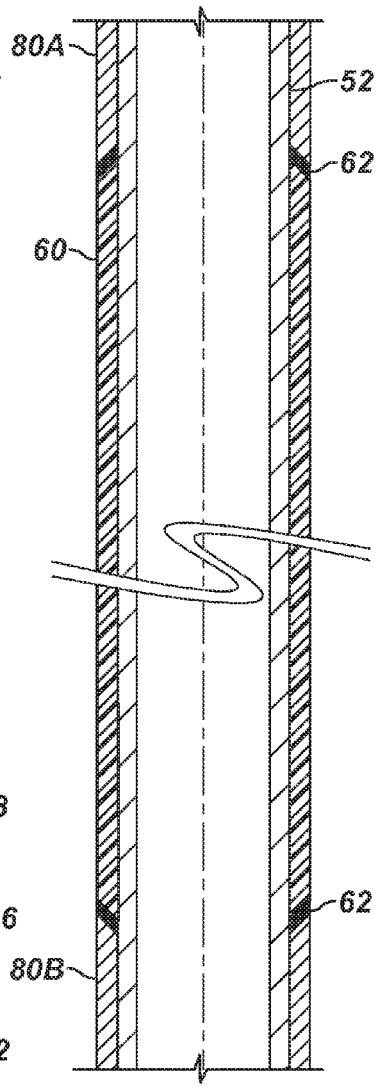
Figure 3C:
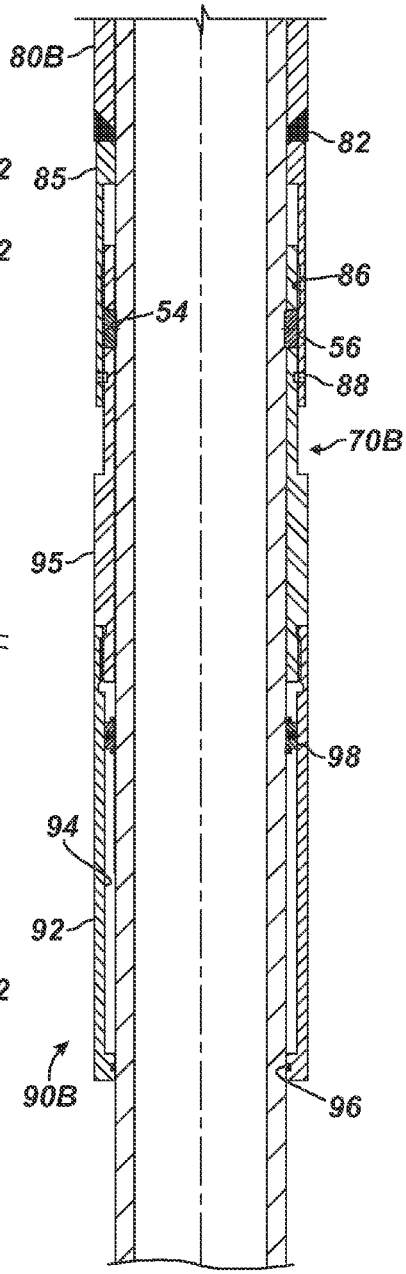

As shown in further detail in FIG. 3B, the swellable element 60 positions onto the outside of the mandrel 52 and can be bonded thereto using conventional techniques. The compressible packers 80A-B mount on the mandrel 52 at each end of the swellable element 60 and are capable of moving axially on the mandrel 52. Back-up rings 62 can be used between the adjoining ends of the swellable element 60 and packers 80A-B. As shown in FIGS. 3A & 3C, additional back-up rings 82 can also position at the ends of the compressible packers 80A-B.

Beyond the compressible packers 80A-B, the isolation elements 70A-B (shown in FIGS. 3A & 3C) have sliding sleeves 85A-B movably mounted on the mandrel 52. Each sleeve 85A-B has a proximal end engaging one of the packers 80A-B (via a back-up ring 82) and has a distal end engaging a bias or pressure unit 90A-B. Preferably, the bias units 90A-B are modular so that each bias unit 90A-B has a barrel 92 that threads onto an anchoring sleeve 95. The anchoring sleeves 95 couple to the sliding sleeves 85 by shear pins 88, although other temporary connections could be used. The anchoring sleeves 85 also have slots for dogs 56 that fit into a groove 54 in the mandrel 52. When engaged in this groove 54, the dogs 56 releasably affix or retain the bias units 90A-B in place on the mandrel 52 as an additional form of temporary connection on the packer 50.

Each barrel 92 encloses a variable chamber 94 around the mandrel 52 that contains atmospheric pressure or other low pressure level sealed therein by seals 96/98. For example, a lip on the end of the barrel 92 has an outer sealing ring 96 that engages the outside of the mandrel 52. Also, an inner sealing ring 98 disposed on the outside of the mandrel 52 engages an inside of the barrel 92 to enclose the chamber 94, although other forms of sealing could be used.

Figure 4A:
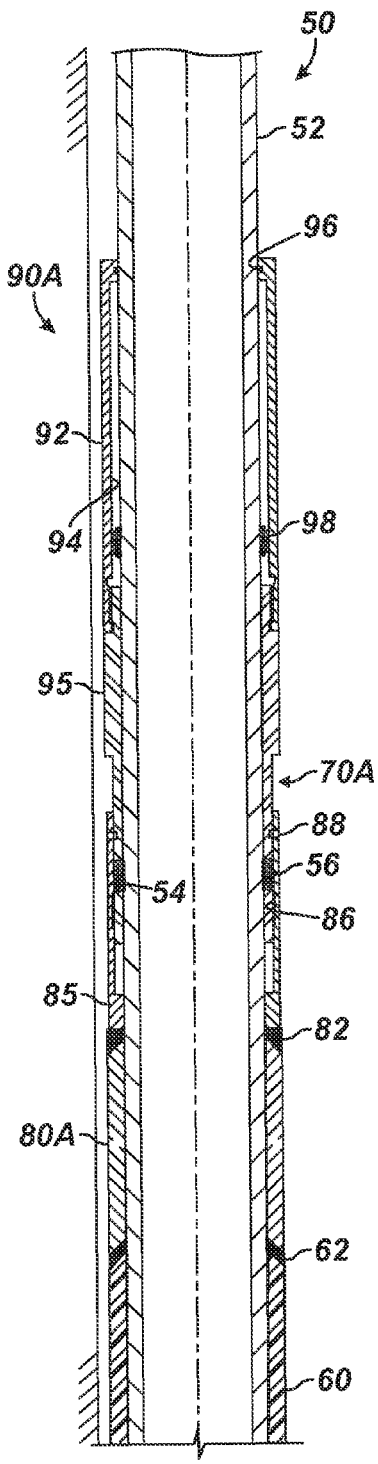
FIGS. 4A-4C show portion of the packer in FIG. 2 during various stages of deployment.

With an understanding of the components of the packer 50, discussion now turns to how the packer 50 is deployed and used downhole. As shown in the partial view of FIG. 4A, the packer 50 is initially deployed with the swelleable element 60 unexpanded. Also, the sliding sleeve 85 is affixed to the anchoring sleeve 95 with the shear pins 88, and the bias unit's sleeve 95 and barrel 92 are held in place on the mandrel 52 by the dogs 56 engaged in the mandrel's groove 54. (Although not shown, the opposite portion of the packer 50 is similarly arranged.)

As noted previously, the chamber 94 has atmospheric pressure or some other low pressure level when assembled at the surface. When the packer 50 is deployed in the wellbore, however, the high pressure environment of pumped or existing fluids in the annulus tends to compress this chamber 94 and force the barrel 92 and attached sleeve 95 axially on the mandrel 52 towards the compressible packer 80A. Yet, the barrel 92 initially remains fixed on the mandrel 52, being retained by the dogs 56 engaged in the mandrel's groove 54.

Eventually, a pumped or existing activating agent in the downhole annulus interacts with the swellable element 60, causing it to expand both axially and radially. (For example, operators may use a mud system 30 as depicted in FIG. 1 to pump the activating agent downhole via the drill string 22, and the agent may enter the annulus via a bottom hole assembly, a sliding sleeve, or the like). The swellable element's radial expansion can eventually seal the element 60 against the surrounding borehole wall, although this can take several days to complete.

Meanwhile, the swellable element's axial expansion pushes against the adjacent compressible packer 80A. In turn, the packer 80A pushes against the adjacent sliding sleeve 85. When enough force is achieved, the shear pins 88 break, allowing the sliding sleeve 85 to shift along the anchoring sleeve 95 and away from the swellable element 60. In some implementations, the swellable element 60 may produce about 100 to 200-psi of force so that the breakable connection provided by the shear pins 88 or other temporary connection would need to be configured accordingly.

Figure 4B:
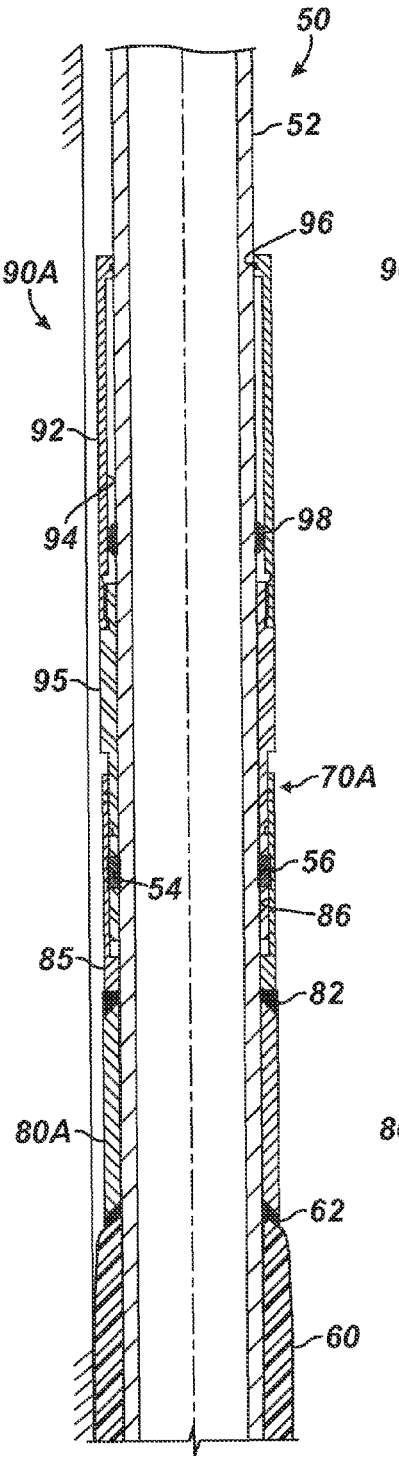

As shown in FIG. 4B, an inner groove 86 on the inside of the shifted sliding sleeve 85 eventually meets the dogs 56, giving the dogs 56 the freedom to disengage from the mandrel's groove 54. As a result, the anchoring sleeve 85 is released from the mandrel 52 and is free to move axially on the mandrel 52. At this point, external pressure exerted on the released barrel 92 moves it axially along the mandrel 52 toward the swellable element 60 because the lower pressure in the chamber 94 attempts to decrease in volume relative to the higher surrounding pressure in the wellbore annulus.

Figure 4C:
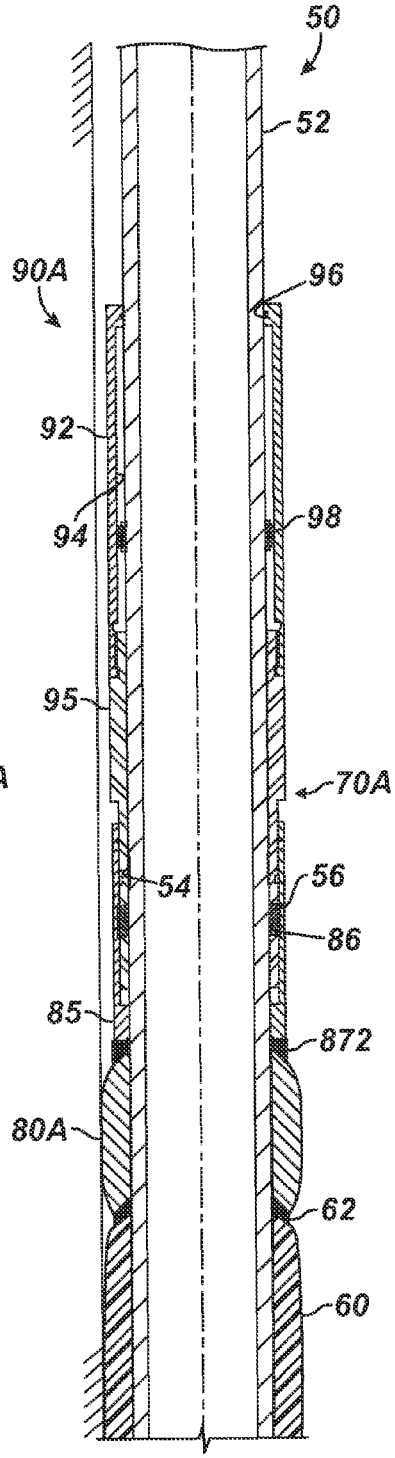

As shown in FIG. 4C, the shifting barrel 92 pushes the sleeves 85/95 axially toward the swellable element 60, and the shifting sleeve 85 pushes against the compressible packer 80A. Concurrently, the swellable element 60 pushes against the packer 80A from the other side as it continues to swell axially. This compression deforms the packer 80A outward to engage the surrounding borehole wall to at least partially isolate the swellable element 60 from the downhole annulus or to form a secondary seal with the borehole wall.

Because the chamber 94 can have atmospheric pressure therein, the chamber 94 will move the barrel 92 as long as the packer 50 is run to a minimum depth for downhole pressure to actuate the barrel 92. Therefore, the pressure in the chamber 94 can be set for a particular implementation. Using the chambers 94 to energize the compressible packer 80A instead of—relying on the force generated by the swellable element 60 means that the force applied to the compressible packer 80A will likely not diminish over time. Although the current arrangement uses the barrel 92 and chamber 94 to provide the biasing force to compress the compressible packer 80A, other biasing arrangements that use springs or fluid filled chambers can be used in place of or in combination with this current arrangement. (See e.g., FIGS. 5 & 6).

The counterforce from the bias unit 90A and the compressible packer 80A can help limit the axial movement of the swellable element 60, thereby making the element 60 swell more radially outward to effectively engage the surrounding borehole wall as intended and limiting the possible extrusion of the swellable element 60 as its swells. In addition, the seal (entire or partial) provided by the compressible packer 80A can isolate the downhole annulus in which the swellable element 60 is positioned. This isolates the swellable element 60 from further exposure to wellbore fluids (including the activating agent) that could degrade the element's material over time.

In the previous arrangement of FIGS. 2 & 3A-3B, the bias units 90A-B use barrels 92 with low pressure chambers 94. When the barrels 92 are released on the mandrel 52, the bias units 90A-B press axially against the compressible packers 80A-B. In an alternative arrangement shown in FIG. 5, the packer 50 has a bias unit 100 that uses a spring 102 and a fixed ring 104. The sliding sleeve 85 is released to move on the mandrel 52 to free the dogs 56 and the anchoring sleeve 95 in the same way discussed previously. With the anchoring sleeve 95 released, the spring 102 pushes away from the fixed ring 104 to compress the compressible packer 80A.

Figure 5:
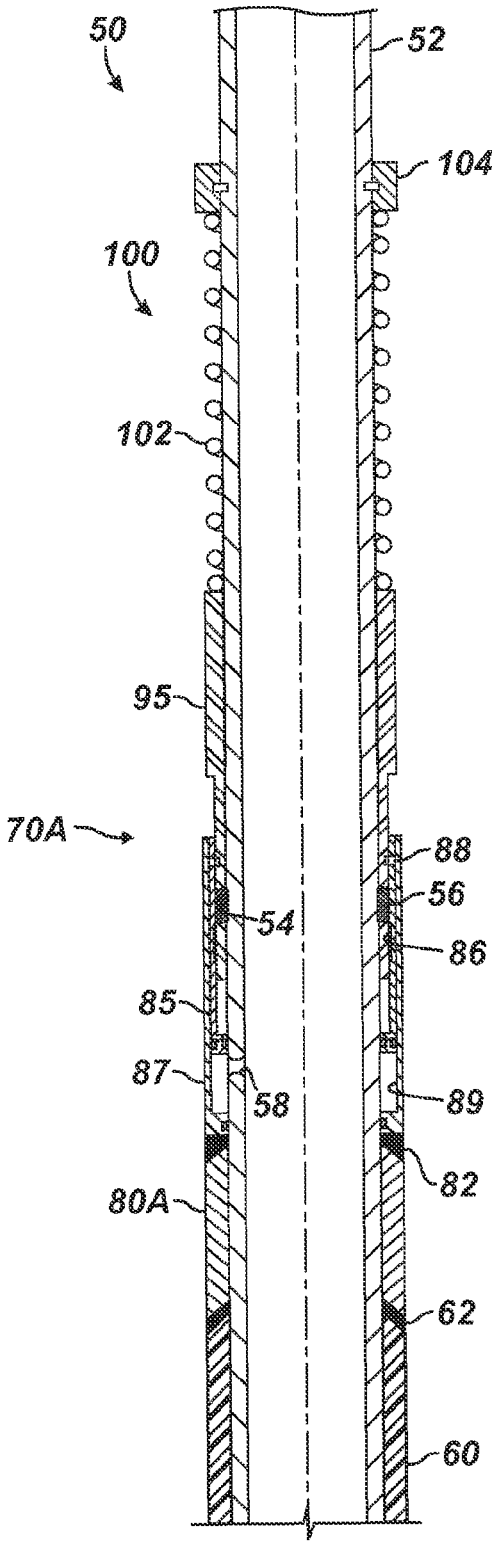
FIG. 5 illustrates portion of another packer according to certain teachings of the present disclosure that is activated by fluid pressure and that has an alternate bias unit.

In the previous arrangements of FIGS. 2 & 3A-3B, the bias units 90A-B are released by the axial movement of the swellable element 60 pushing the compressible elements 80A-B and the sleeves 85 until the shear pins 88 break and the dogs 56 release the anchoring sleeves 95. As an alternative, the packer 50 can use bias units that are mechanically or hydraulically released apart from the swelling of the swellable element 60. In FIG. 5, for example, the bias unit (depicted here as the spring-based unit 100) is released by fluid pressure. As shown, the sliding sleeve 85 is surrounded by an outer sliding sleeve 87, and the mandrel 52 has one or more ports 58 that communicate the mandrel's bore with a sealed chamber 89 between the sleeves 85/87.

To activate the packer 50's bias unit 100, pumped fluid in the mandrel's bore enters the sealed chamber 89 through the port 58. Increased fluid pressure in this chamber 89 pushes the inner sliding sleeve 85 to break the shear pins 88. Once freed, the inner sliding sleeve 85 moves axially on the mandrel 52 and releases the dogs 56. With the dogs 56 released, the bias unit 100 pushes the anchoring sleeve 95 along the mandrel 52 and engages both sleeves 85/87. Pushed further by the bias unit 100, these sleeves 85/87/95 then compress against the compressible packer 80A to deform it. Although shown in connection with the spring-based unit 100, this alternate form of activation in FIG. 5 using fluid pressure can be applied to the other bias units disclosed herein.

Figure 6:
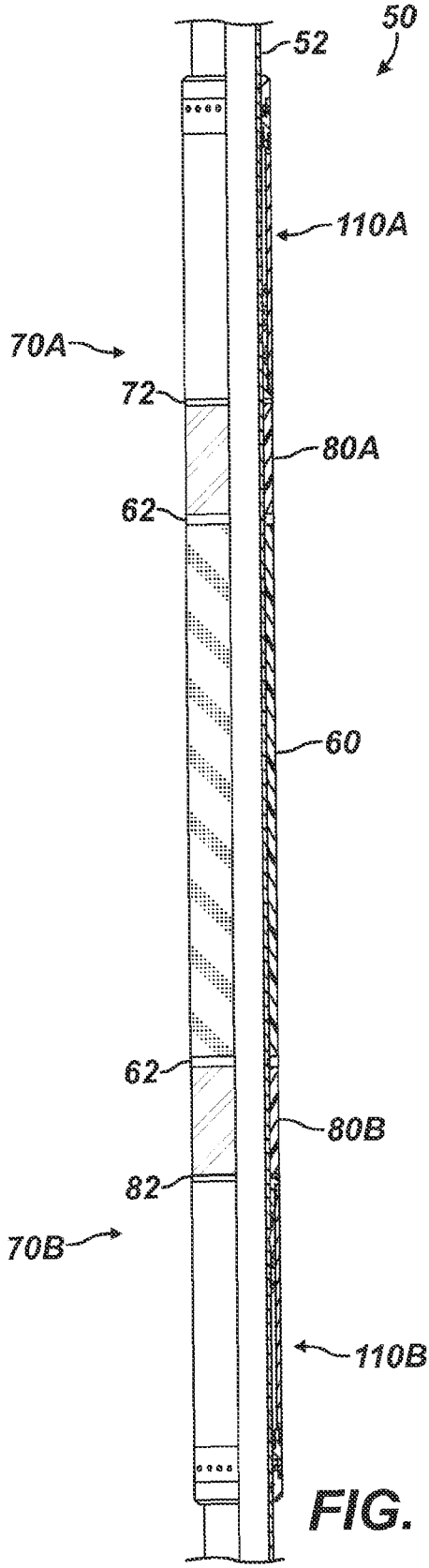
FIG. 6 illustrates a partial cross-section of yet another packer according to certain teachings of the present disclosure that is activated by fluid pressure and that has another bias unit.

In FIG. 6, another packer 50 is activated by fluid pressure. Again, this packer 50 has a swellable element 60 with isolation elements 70A-B flanking each end and has back-up rings 62/82 used at the ends of the elements 60/70A-B. Similar to previous arrangements, this packer 50 also uses bias units 110A-B disposed on the mandrel 52 beyond the compressible packers 80A-B. However, these bias units 110A-B are activated and moved directly by fluid pressure as discussed below.

Figures 7A, 7B, 7C:
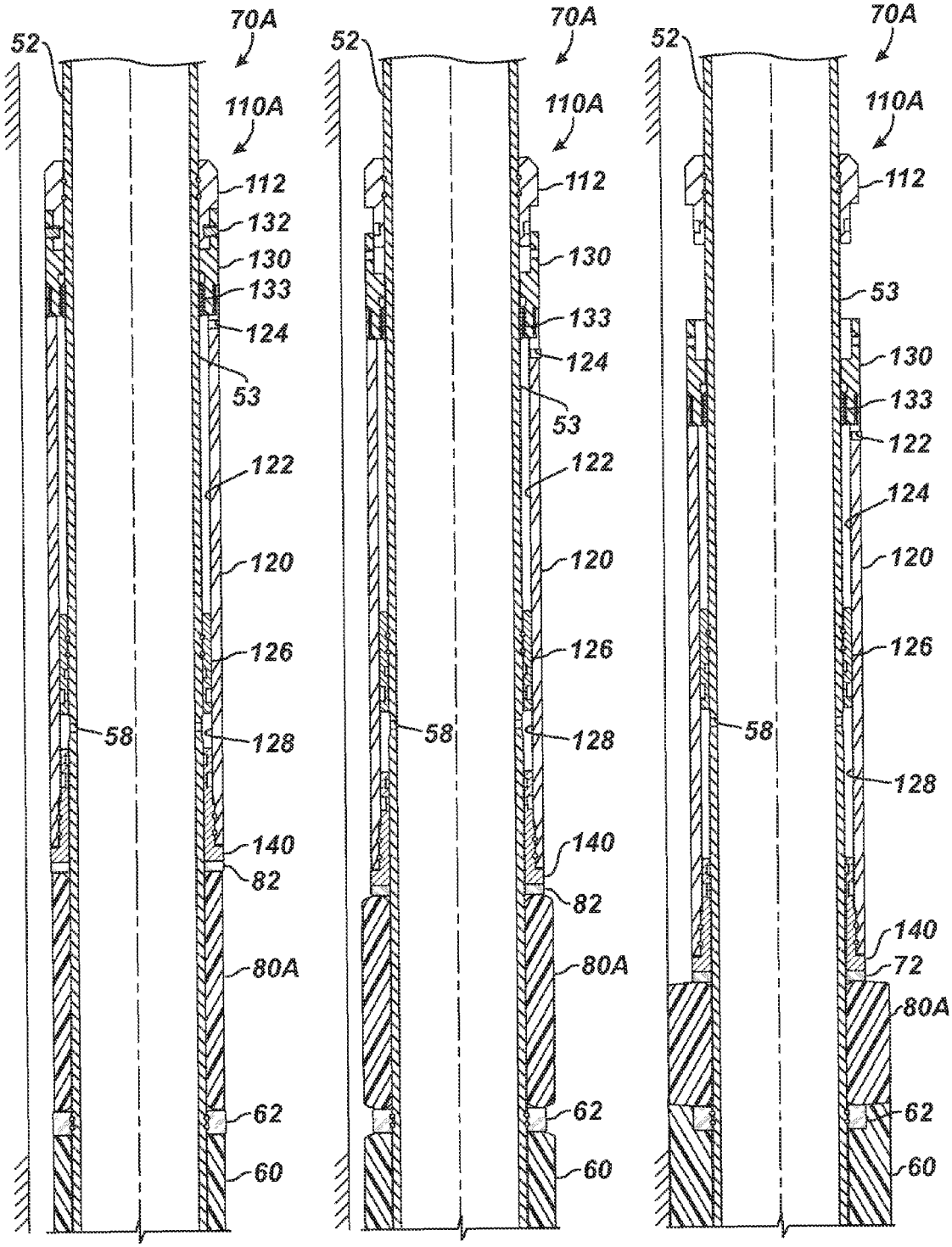
FIGS. 7A-7C show portion of the packer in FIG. 6 during various stages of deployment.

As shown in detail in FIG. 7A, the bias unit 110A has a retention shoulder 112 affixed to the outside of the mandrel 52 and has a barrel 120 mounted on the mandrel 52 between the retention shoulder 112 and the compressible packer 80A. Towards the shoulder 112, the barrel 120 connects to a lock ring 130. Shear pins 132 or the like temporarily affix the lock ring 130 (and barrel 120) to the shoulder 112, and a ratchet mechanism 133 on the lock ring 130 engages a serrated surface 53 on the outside of the mandrel 52. Towards the compressible packer 80A, the barrel 120 connects to an engagement ring 140 that fits against the compressible packer 80A (via a back-up ring 82).

Internally, a sealing ring 126 affixed to the mandrel 52 separates the enclosed space inside the barrel 120 into a discharge chamber 122 and a charge chamber 124. Fluid can enter the charge chamber 128 via a port 58 in the mandrel 52. Likewise, fluid can leave the discharge chamber 122 via a discharge outlet 124. (Although not shown, the opposite portion of the packer 50 is similarly arranged.)

As shown in FIG. 7A, the packer 50 is initially deployed downhole with the barrel 120 connected to the retention shoulder 112 by the shear pins 132. As before, the presence of an activating agent (being either pumped or existing downhole) causes the swellable element 60 to swell. The back-up ring 62 adjacent the swellable element 60 can be affixed to the mandrel 52 as shown and can retain the axial swelling of the swellable element 60. However, the ring 62 could be free to move along the mandrel 52.

Meanwhile, pumped fluid (which can include the activating agent) passing through the mandrel 52 enters the charge chamber 128 via the mandrel's port 58. As fluid pressure builds, it forces the barrel 120 towards the compressible packer 80A, but the shear pins 132 prevent the barrel 120 from moving. Eventually as shown in FIG. 7B, the fluid pressure breaks the shear pins 132 holding the barrel's lock ring 130 to the retention shoulder 112. At this point, the barrel's charge chamber 128 expands with filling fluid, while the discharge chamber 122 in turn decreases in volume, expelling fluid from the outlet 124.

As the barrel 120 is biased axially toward the compressible packer 80A, the build-up of fluid pressure causes the barrel's engagement shoulder 140 to press against the compressible packer 80A. The force applied can be over several thousand psi to deform the compressible packer 80A. Meanwhile, the ratchet mechanism 133 ratchets along the mandrel's serrated surface 53, preventing the barrel 120 from returning towards the retention shoulder 112. Eventually as shown in FIG. 7C, the shoulder 140 causes the compressible packer 80A to deform and expand radially outward toward the surrounding borehole wall. In this way, the bias unit 110A biased axially against the compressible packer 80A can at least partially isolate the swellable element 60 from the downhole annulus.

Figure 8:
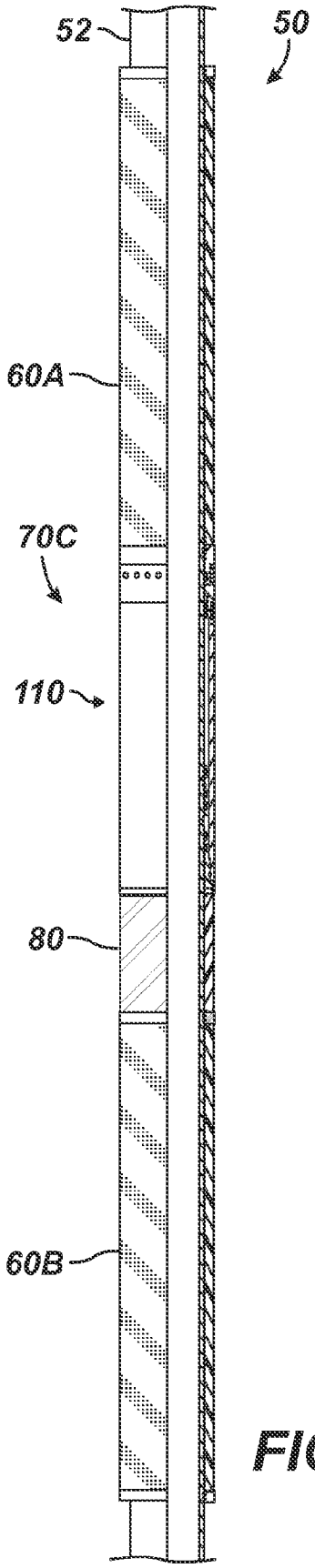
FIG. 8 shows a packer according to certain teachings of the present disclosure having a different symmetrical arrangement.

In previous arrangements, the packer 50 has a symmetrical arrangement with isolation elements 70A-B flanking both ends of the swellable element 60. (See e.g., FIGS. 2 & 6.) In a different symmetrical arrangement shown in FIG. 8, the packer 50 has an isolation element 70C flanked by swellable elements 60A-B. Although depicted with a compressible packer 80 and a bias unit 110 as in FIG. 6, the isolation element 70C can use a different arrangement disclosed herein. The packer 50 can operate as discussed above with the swellable elements 60A-B swelling in the presence of an activating agent and the isolation element 70C at least partially isolating the swellable elements 60A-B from portions of the downhole annulus.

Figure 9:
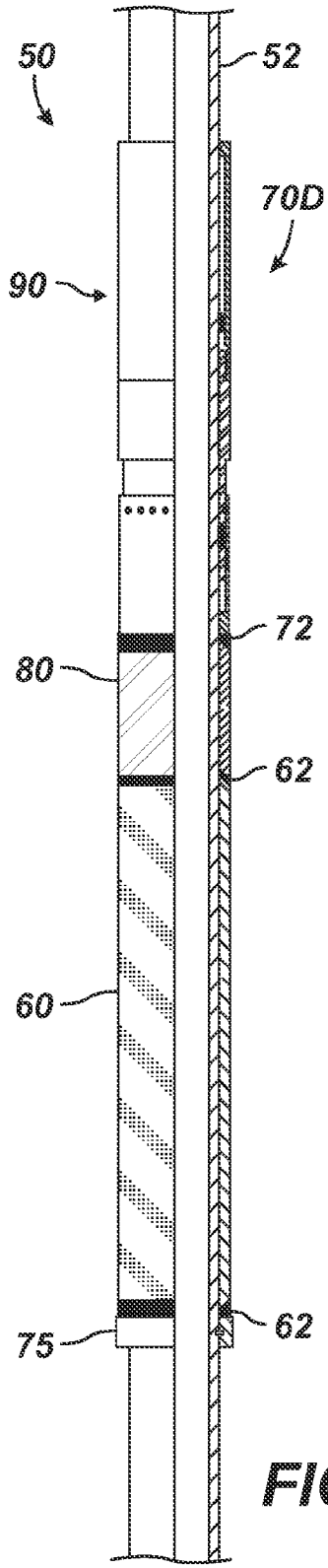
FIG. 9 shows a packer according to certain teachings of the present disclosure having an asymmetrical arrangement.

As an alternative to a symmetrical arrangement, the packer 50 can have an asymmetrical arrangement. In FIG. 9, for example, the packer 50 has one isolation element 70D disposed on the mandrel 52 at one end of the swellable element 60 as before. Here, the isolation element 70D uses a compressible packer 80 and a bias unit 90 as in FIG. 2, although a different form of isolation element disclosed herein could be used. Rather than having another isolation element flank the swellable element 60, a retaining shoulder 75 is instead affixed to the mandrel 52 at the other end of the swellable element 60. Being affixed, the shoulder 75 can stop the axial expansion of the swellable element 60 along the mandrel 52. As an alternative to the fixed shoulder 75, however, the swellable element's end can be fixed to mandrel 52 by another mechanism, or it can be free moving on the mandrel 52 or biased by a spring or other biasing mechanism. The rest of packer 50 in FIG. 9 can operate the same way as described previously.

Figure 10:
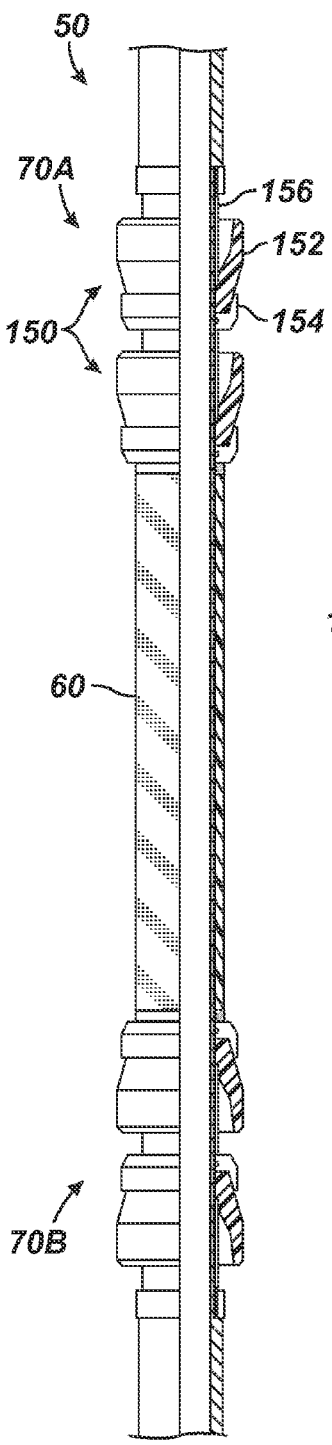
FIG. 10 illustrates a packer according to certain teachings of the present disclosure having alternate deformable elements flanking a swellable element.

In previous arrangements, the isolation elements 70A-B use compressible packers 80A-B that are deformed outwardly toward the surrounding borehole wall by compression. In FIG. 10, the isolation elements 70A-B of the packer 50 use alternate deformable elements flanking a swellable element 60. Here, the isolation elements 70A-B each have a pair of cup packers 150, although only one cup packer may be used. Each cup packer 150 has a cup element 152 affixed to the mandrel 52 by a retention ring 154 and sleeve 156.

When deployed downhole, the cup packers 150 of the elements 70A-B at least partially isolate the swellable element 60 from the downhole annulus, thereby preventing fluid loss while the swellable element 60 takes time to swell and limiting over exposure of the element 60 to downhole fluids. For example, the first element 70A can prevent fluid buildup uphole from the packer 50 from passing downhole while the swellable element 60 is swelling with time. Likewise, the second element 70B can prevent fluid buildup downhole from the packer 50 from passing uphole.

Figure 11:
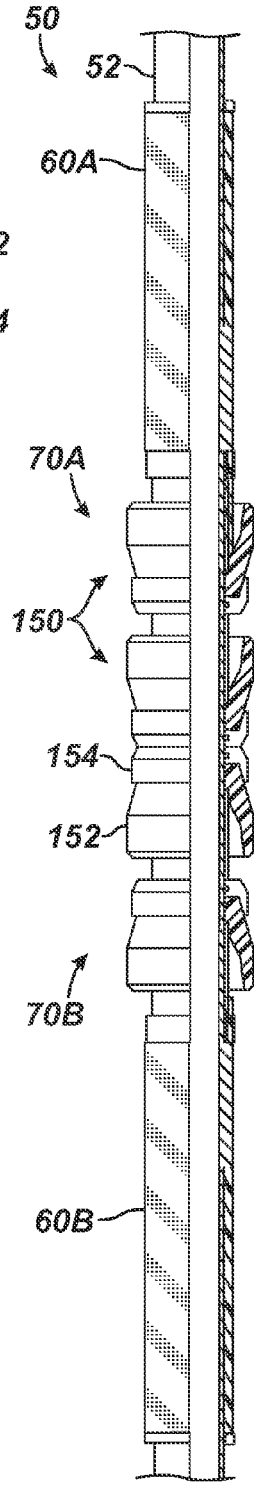
FIG. 11 illustrates the packer of FIG. 10 with an inverted arrangement.

The packer 50 in FIG. 11 has an inverted arrangement with oppositely directed isolation elements 70-B flanked by first and second swellable elements 60A-B. In this inverted arrangement, the first element 70A can prevent fluid buildup uphole from the packer 50 from passing downhole while the lower swellable element 60B is swelling with time. Likewise, the second element 70B can prevent fluid buildup downhole from the packer 50 from passing uphole to the upper swellable element 60A as it swells.

Figure 12:
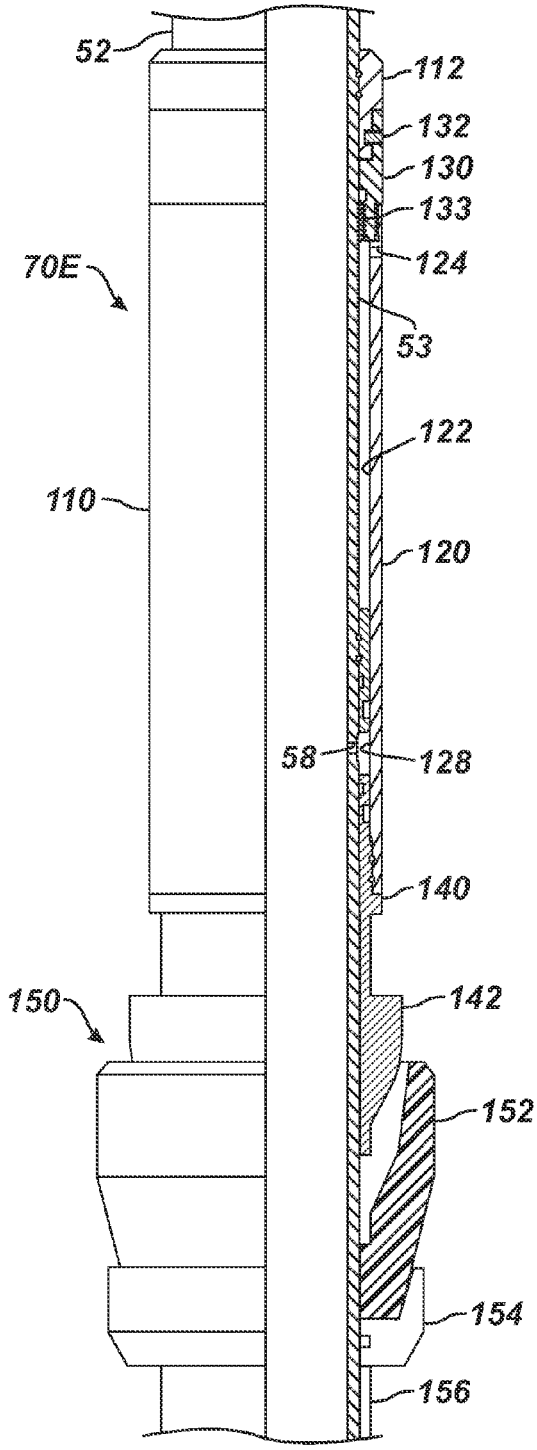
FIG. 12 illustrates portion of a packer according to certain teachings of the present disclosure having a cup packer deformable by a bias unit.

The cup packers 150 in FIGS. 10-11 deform radially outward either by natural bias or by a build-up of fluid pressure biasing against the inside of the cup packer 50. In an alternative arrangement shown in FIG. 12, an isolation element 70E has a cup packer 150 and a bias unit 110. Although the bias unit 110 shown here is similar to that described above in FIGS. 6 & 7A-7C, any of the other bias units disclosed herein could be used. The bias unit 110 operates as discussed previously, but the engagement shoulder 140 coupled to the barrel 120 has an expanding contour 142. When moved axially towards the cup packer 150, this contour 142 helps to deform the cup packer 150 radially outward toward the surrounding borehole wall to at least partially isolate the downhole annulus.

An adjacent cup packer (not shown) disposed on the mandrel 52 may or may not also undergo a similar expansion. For example, the sleeve 156 engaged by the cup packer's ring 154 may simply fit against the adjacent cup packer (not shown) in a similar way shown previously. Alternatively, the sleeve 156 can have a similar expanding contour to deform the adjacent cup packer (not shown), especially if the ring 154 is allowed to move along the mandrel 52.

As disclosed herein, swelling of the swellable element 60 can be initiated in a number of ways. For example, oil, water, or other activating agent existing downhole may swell the element 60, or operators may introduce the agent downhole. In general, the swellable element 60 can be composed of a material that an activating agent engorges and causes to swell. Any of the swellable materials known and used in the art can be used for the element 60. For example, the material can be an elastomer, such as ethylene propylene diene M-class rubber (EPDM), ethylene propylene copolymer (EPM) rubber, styrene butadiene rubber, natural rubber, ethylene propylene monomer rubber, ethylene vinylacetate rubber, hydrogenated acrylonitrile butadiene rubber, acrylonitrile butadiene rubber, isoprene rubber, chloroprene rubber and polynorbornen, nitrile, VITON® fluoroelastomer, AFLAS® fluoropolymer, KALREZ® perfluoroelastomer, or other suitable material. (AFLAS is a registered trademark of the Asahi Glass Co., Ltd., and KALREZ and VITON are registered trademarks of DuPont Performance Elastomers). The swellable material of the element 60 may or may not be encased in another expandable material that is porous or has holes.

What particular material is used for the swellable element 60 depends on the particular application, the intended activating agent, and the expected environmental conditions downhole. Likewise, what activating agent is used to swell the element 60 depends on the properties of the element's material, the particular application, and what fluid (liquid and gas) is naturally occurring or can be injected downhole. Typically, the activating agent can be mineral-based oil, water, hydraulic oil, production fluid, drilling fluid, or any other liquid or gas designed to react with the particular material of the swellable element 60.

As disclosed herein, the deformable elements used for the isolation elements 70 can be compressible packers 80 or cup packers 150. It will be appreciated that other deformable elements could be used, including, but not limited to, metallic rings, elastomeric seals, etc. In general, these deformable elements (e.g., compressible packers 80, cup packers 150, etc.) can be composed of any expandable or otherwise malleable material such as metal, plastic, elastomer, or combination thereof that can stabilize the packer 50 and withstand tool movement and thermal fluctuations within the borehole. In addition, the compressible packers 80 when used can be uniform or can include grooves, ridges, indentations, or protrusions designed to allow the packers to conform to variations in the shape of the interior of the borehole. Moreover, the cup packer 150 when used may be formed of any suitable type elastomeric material and may contain suitable reinforcing materials therein.

As disclosed herein, the combination of one or more swellable elements 60 and one or more isolation elements 70 on the packer 50 produces a dual sealing system. The isolation elements 70 can provide a more immediate seal or isolation with the surrounding borehole wall, while the swellable elements 60 may enlarge over time and produce a seal along a longer expanse of the borehole. As discussed above, an isolation element 70 flanking each end of a swellable element 60 can help contain the swellable element 60, limiting its extrusion and engorgement that may weaken the element 60 overtime. In addition, the elements 60/70A-B may or may not be configured to work independently of one another as discussed previously.

As disclosed herein, the swellable element 60 has been described as providing a primary seal while the isolation elements 70A-B provide secondary seals or at least partially isolate the swellable element 60 from the downhole annulus. This should not be taken to mean that one seal is stronger than the other, encompasses a greater volume of the borehole's annulus, is superior to the other, etc. Rather, particular characteristics of the various seals produced can be configured for a given implementation and may be intentionally varied. In fact, some implementations of the packer 50 may only require that the swellable element 60 expand enough axially to activate the bias units (e.g., 90 of FIG. 3A), but not actually produce a complete seal with the surrounding borehole wall. In addition, some implementations of the packer 50 may only require that the isolation elements 70 provide an axial force counter to the swellable element 60 and at least partially deform toward the surrounding borehole wall, but not form a complete seal therewith. In any event, the amount of travel required to form the seals with the elements 60/70A-B depends on the volume to be sealed, the distance to the surrounding borehole wall, and the particulars of the desired implementation.

The foregoing description of preferred and other embodiments is not intended to limit or restrict the scope or applicability of the inventive concepts conceived of by the Applicants. Arrangements disclosed in one embodiment can be combined or exchanged with those disclosed for another arrangement herein. As one example, a packer having a swellable element 60 and isolation elements 70A-B can use one type of bias unit (e.g., 90 as in FIG. 3A) for one compressible packer (e.g., 80A) and another type of bias unit (e.g., 110 as in FIG. 7A) for the other compressible packer (e.g., 80B). These and other arrangements will be apparent to one skilled in the art having the benefit of the present disclosure.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising:
a mandrel;
a swellable packer disposed on the mandrel and being swellable within a downhole annulus in the presence of an activating agent; and
an isolation element disposed on the mandrel adjacent the swellable packer, the isolation element being at least partially deformable radially outward to a surrounding borehole wall and at least partially isolating the swellable element from a portion of the downhole annulus, comprising:
a first element deformable radially outward; and
a bias unit releasably affixed on the mandrel adjacent the first element, axially biasable toward the first element to at least partially deform the first element radially outward to the surrounding borehole wall,
wherein the bias unit is axially releasable on the mandrel in response to at least one of:
axial swelling of the swellable packer; or
fluid pressure conveyed through the mandrel.

2. The tool of claim 1, wherein the swellable packer swells radially outward to the surrounding borehole wall to form a seal therewith.

3. The tool of claim 1, wherein the swellable packer comprises an elastomeric material disposed on an outer surface of the mandrel and being swellable in the presence of the activating agent selected from the group consisting of a fluid, a gas, an oil, water, production fluid, and drilling fluid.

4. The tool of claim 1, wherein the first element comprises at least one cup packer being biased to deform radially outward and oriented to restrict fluid flow in at least one direction.

5. The tool of claim 1, wherein the first element comprises:
at least one first cup packer being biased to deform radially outward and oriented to restrict fluid flow in a first direction; and
at least one second cup packer being biased to deform radially outward and oriented to restrict fluid flow in a second direction opposite the first direction.

6. The tool of claim 1, wherein the first element comprises:
a compressible packer being compressible to deform radially outward.

7. The tool of claim 1, wherein the isolation element comprises a sleeve disposed on the mandrel between the first element and the bias unit and being affixable to the bias unit by a breakable connection, the axial swelling of the swellable packer moving the sleeve and breaking the breakable connection between the sleeve and the bias unit.

8. The tool of claim 7, wherein the bias unit comprises at least one dog being engageable with the mandrel to releasably affix the bias unit on the mandrel, and wherein the movement of the sleeve releases the at least one dog from engagement with the mandrel.

9. The tool of claim 1, wherein the bias unit comprises a barrel disposed on the mandrel and containing a chamber with an internal pressure, the bias unit being axially biasable toward the first element in response to external pressure being greater than the internal pressure.

10. The tool of claim 1, wherein the bias unit comprises a spring disposed on the mandrel and being biased toward the first element.

11. The tool of claim 1, wherein the mandrel defines a port communicating with the fluid pressure conveyed through the mandrel, and wherein the isolation element comprises a sleeve disposed on the mandrel between the first element and the bias unit and being affixable to the bias unit by a breakable connection, the fluid pressure conveyed through the port moving the sleeve and breaking the breakable connection between the sleeve and the bias unit.

12. The tool of claim 11, wherein the bias unit comprises at least one dog being engageable with the mandrel to releasably affix the bias unit on the mandrel, and wherein the movement of the sleeve releases the at least one dog from engagement with the mandrel.

13. The tool of claim 1, wherein the mandrel defines a port communicating with the fluid pressure conveyed through the mandrel, and wherein the bias unit comprises a barrel disposed on the mandrel and containing a chamber, the barrel being axially biasable toward the first element in response to the fluid pressure communicated into the chamber via the port.

14. The tool of claim 13, wherein the barrel is affixable to the mandrel by a breakable connection, the fluid pressure in the chamber moving the barrel and breaking the breakable connection between the barrel and the mandrel.

15. The tool of claim 13, wherein the bias unit comprises a ratchet mechanism engaging the mandrel and preventing movement of the barrel away from the first element.

16. The tool of claim 1, further comprising a second swellable packer disposed on the mandrel on an opposite end of the isolation element, the second swellable packer being swellable within the downhole annulus in the presence of the activating agent.

17. The tool of claim 1, further comprising a second isolation element disposed on the mandrel adjacent an end of the swellable packer opposite the other isolation element, the second isolation element being at least partially deformable radially outward to the surrounding borehole wall and at least partially isolating the swellable element from a portion of the downhole annulus.

18. A downhole tool, comprising:

a mandrel;

a swellable packer disposed on the mandrel and being swellable within a downhole annulus in the presence of an activating agent;

a compressible packer disposed on the mandrel adjacent the swellable packer; and a bias unit releasably affixed on the mandrel adjacent the compressible packer, the bias unit being releasable on the mandrel and being axially biasable toward the high compressible packer to at least partially deform the compressible packer radially outward to a surrounding borehole wall, wherein the bias unit is axially releasable on the mandrel in response to one of:

axial swelling of the swellable packer; or fluid pressure conveyed through the mandrel.

19. The tool of claim 18, wherein the bias unit comprises:

a barrel disposed on the mandrel and containing a chamber with an internal pressure, the barrel being axially biasable toward the compressible element in response to external pressure being greater than the internal pressure;

a sleeve disposed on the mandrel between the compressible packer and the barrel and being affixable to a portion of the barrel by a breakable connection; and at least one dog being engageable with the mandrel and releasably affixing the barrel on the mandrel, wherein the movement of the sleeve releases the at least one dog from engagement with the mandrel.

20. The tool of claim 19, wherein the axial swelling of the swellable packer moves the sleeve and breaks the breakable connection between the sleeve and the barrel.

21. The tool of claim 19, wherein the mandrel defines a port communicating with fluid pressure conveyed through the mandrel, the fluid pressure moving the sleeve to break the breakable connection between the sleeve and the barrel.

22. The tool of claim 18, wherein the mandrel defines a port communicating with fluid pressure conveyed through the mandrel, and wherein the bias unit comprises a barrel disposed on the mandrel and containing a chamber, the barrel being axially biasable toward the compressible packer in response to the fluid pressure communicated into the chamber via the port.

23. The tool of claim 22, wherein the barrel is affixable to the mandrel by a breakable connection, the fluid pressure in the chamber moving the barrel to break the breakable connection between the barrel and the mandrel.

24. The tool of claim 22, wherein the bias unit comprises a ratchet mechanism engaging the mandrel and preventing movement of the barrel away from the compressible packer.

25. A wellbore packing method, comprising:

deploying a tool downhole;

swelling a swellable packer on the tool in a downhole annulus by interacting the swellable packer with an activating agent; and at least partially isolating the swellable element from a portion of the downhole annulus by at least partially deforming a deformable element on the tool radially outward to a surrounding borehole wall, comprising:

releasing a bias unit on the tool responsive to one of:

swelling of the swellable element; or fluid pressure communicated through the tool; and biasing the released bias unit axially on the tool toward the deformable element.

26. The method of claim 25, wherein interacting the swellable element with the activating agent comprises pumping the activating agent downhole.

27. The method of claim 25, wherein interacting the swellable element with the activating agent comprises exposing the swellable element to existing fluid downhole.

28. The method of claim 25, wherein the deformable element comprises at least one cup packer disposed on the tool.

29. The method of claim 25, wherein the deformable element comprises at least one compressible packer disposed on the tool.

30. The method of claim 25, wherein biasing the released bias unit comprises filing a chamber in the bias unit with the fluid pressure communicated through the tool.

31. The method of claim 25, wherein the released bias unit is biased axially on the tool in response to external pressure downhole.

* * * * *